US005964520A

United States Patent [19]

Lee

[11] Patent Number: 5,964,520

[45] Date of Patent: Oct. 12, 1999

[54] CHRISTMAS TREE LIGHT

[76] Inventor: Hung Wen Lee, c/o P S I Sales, Inc. 436 Vista Parada, Newport Beach, Calif. 92660

[21] Appl. No.: 09/156,725

[22] Filed: Sep. 18, 1998

Related U.S. Application Data

[63] Continuation of application No. 08/990,704, Dec. 15, 1997.

[51] Int. Cl.[6] ..... F21V 29/00

[52] U.S. Cl. ..... 362/294; 362/249; 362/806; 362/226

[58] Field of Search ..... 362/96, 226, 294, 362/249, 373, 123, 806, 218; 439/194, 356, 611, 619

[56] References Cited

U.S. PATENT DOCUMENTS

| | | | |
|---|---|---|---|
| 5,605,395 | 2/1997 | Peng | 362/294 |
| 5,709,457 | 1/1998 | Hara | 362/294 |
| 5,772,771 | 3/1998 | Wang | 362/294 |

*Primary Examiner*—Thomas M. Sember
*Attorney, Agent, or Firm*—Myron Amer P.C.

[57] ABSTRACT

An outdoor Christmas tree-type miniature decoration light in the use of which beads of rain on an elevated length portion of an electrical conductor will seek its level and flow to the positive and negative contacts of the light, and wherein contact-separating means and discharge ports are strategically located to prevent inflowing rain water from causing a short circuit.

1 Claim, 1 Drawing Sheet

CHRISTMAS TREE LIGHT

This is a continuation of application Ser. No. 08/990,704, filed Dec. 15, 1997.

The present invention relates generally to outdoor tree decoration, in which the tree typically is a Christmas tree, and the decoration is in the specific form of miniature lights in a string draped over the branches and foliage of the tree, and more particularly to structural features embodied in the miniature light to obviate short-circuiting in its outdoor use as might be caused by rain and snow.

EXAMPLES OF THE PRIOR ART

Christmas tree miniature light decoration, optionally for both indoor and outdoor use, is already well documented in the prior patented literature as exemplified by U.S. Pat. No. 5,139,343 for "Lamp Holder With Switch Means" issued to Wen-Hsiung Lin on Aug. 18, 1992, by U.S. Pat. No. 5,013,960 for "Christmas Tree Light With Separation Wedge" issued to Jeow N. Tseng on May 7, 1991 and by U.S. Pat. No. 5,331,529 for "Electrical Lamp Base System" to Shun-Feng Huang on Jul. 19, 1994. In the noted patented tree-decorating miniature lights and in all other known similar lights, a socket is seated in a top opening of the miniature light body and the surfaces thereof which contact each other are attempted to be rendered fluid-tight, in order to obviate short-circuiting of the positive and negative electrical contacts located on the socket below the fluid-tight seal. Sealing only the top opening of the miniature light has been found in practice to be only a partial solution.

Broadly, it is an object of the present invention to provide a miniature light with little or no tendency to short circuit during outdoor use overcoming the foregoing and other shortcomings of the prior art.

More particularly, it is an object to use a fluid-tight seal to reduce to a nominal extent any water from entering into the miniature light, and also to provide for effective discharge of any water that does enter to obviate the causing of a short circuit malfunction, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
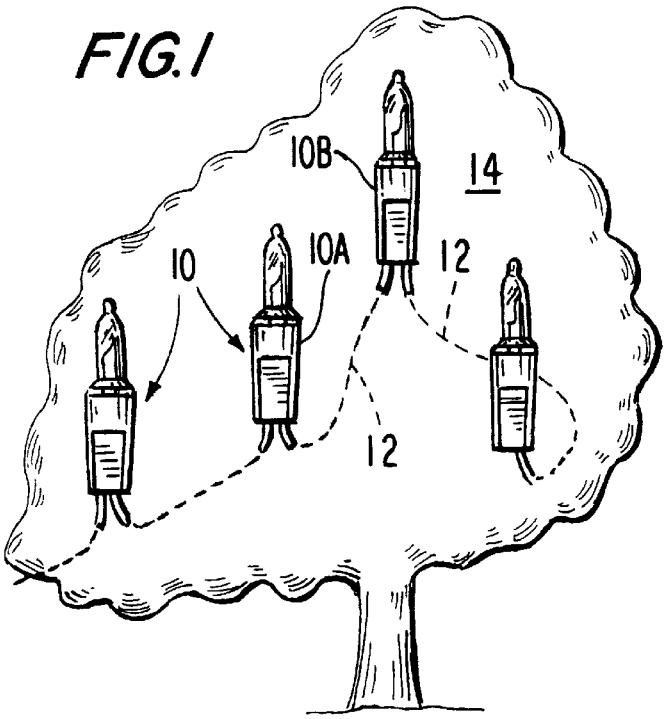
FIG. 1 is a perspective view of the use of a string of the within inventive miniature lights in a typical end use of decorating an outdoor Christmas tree.
Figure 2:
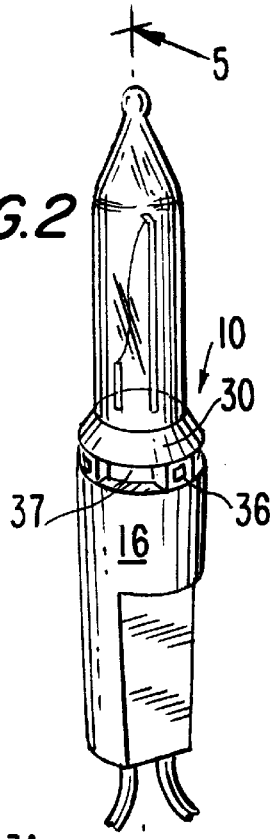
FIG. 2 is a perspective isolated view, on an enlarged scale, of the assembled miniature light.
Figure 3:
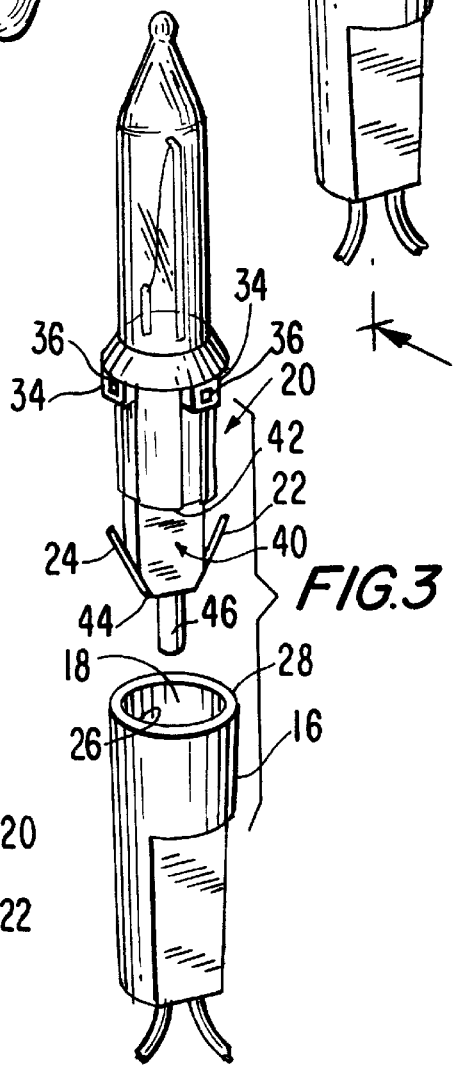
FIG. 3 is a perspective view illustrating an initial assembly step of the assembled miniature light of FIG. 2.
Figure 5:
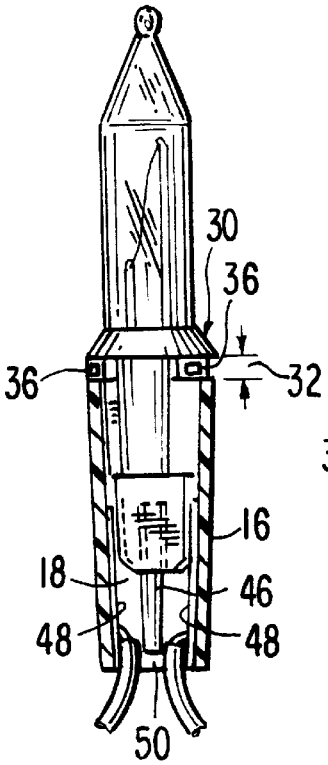
FIG. 5 is a cross sectional view, taken along line 5—5 of FIG. 2.
Figure 4:
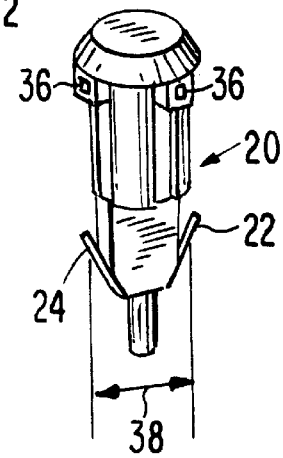
FIG. 4 is an isolated perspective view of the socket component of the miniature light.

FIG. 1 illustrates a recommended end use of a miniature light, generally designated 10, namely in a string interconnected by an insulated electrical wire conductor 12 to provide a decorative light display for an outdoor Christmas tree 14 or the like, in which it is to be noted that adjacent miniature lights, as exemplified by miniature lights 10A and 10B are at different levels or heights, giving rise to a known phenomenon that raindrops beading on the electrical conductor length portion 12 will flow therealong to seek the level of the miniature light 10B when it encounters miniature light 10A and, in so doing, the water flowing into miniature light 10A could cause a short circuit. This shortcoming is obviated by the construction of the within inventive miniature light 10, all as will be better understood as the description proceeds.

In a preferred embodiment, miniature light 10 has a hollow cylindrical body 16 bounding an internal compartment 18 for establishing an electrical connection for illuminating the miniature light, wherein a socket 20 with a positive electrical contact 22 and a negative electrical contact 24 is disposed through an upper body opening 26 bounded by an edge 28 and thusly seated in said opening 26 but with, it is to be noted, a socket circular ring 30 exposed at a height 32 above the opening edge 28. In the exposed circular ring 30 edges 34 bound discharge ports 36 located beneath a radial overhang, as at 37, the significance of which discharge ports 36 will soon be apparent.

The socket 20 mounts the position and negative electrical contacts 22 and 24 in a clearance location from each other, as at 38, and this clearance 38 is used to advantage by using an electrical contact-separating member, generally designated 40, having an upper edge 42 and a lower edge 44, which is attached at its upper edge 42 to extend from the socket 20 so as to interpose its lower edge 44 between the positive and negative electrical contacts 22, 24 and to thus contribute to obviating short-circuiting of the contacts 22, 24.

A lip 46 on the lower edge 44 extends in depending relation into the clearance between and just below the contacts 22 and 24 so as to form two electrical conductor access passages 48 extending from an edge-bounded lower body opening 50 through which the electrical conductor 12 is projected and makes an electrical connection to the electrical contacts 22 and 24.

It is to be noted that rain water droplets, either interconnected with each other or spaced apart (not shown) will, as already noted, seek its level and thus have a tendency to collect in the compartment 18. This tendency is significantly minimized by a flow pattern of the inflowing rain water to flow along the conductor 12 and thus through the access passage 48 which, at its upper end, communicates with the discharge ports 36 and results in a discharge of what otherwise would be collected short-circuiting rain water.

While the tree-decorating miniature light herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for a tree-decorating miniature light of a type used outdoors and having internal positive and negative electrical contacts connected to insulated electrical wire conductors, said improvements comprising a miniature light hollow cylindrical body bounding an internal compartment for establishing an electrical connection to said miniature light, edges in a base of said body bounding an opening into said compartment, electrical conductors inserted in an ascending path of movement through said base opening into said compartment, socket means partially seated in descending movement into said compartment having an exposed unseated upper portion and a seated lower portion having a positive electrical contact and a negative electrical contact in clearance locations from each other, an electrical contact in clearance locations from each other, an electrical contact-separating member having upper and lower edges attached at said upper edge to extend from said socket means and interposing said lower edge between said positive and negative electrical contracts, a lip on said lower edge in depending relation in said clearance between said positive and negative electrical contacts so as to form access passages in said compartment for said electrical conductors extending from said body bottom opening to said positive and negative electrical contracts, and edges in said exposed unseated upper portion of said socket bounding water discharge ports oriented transversely of said access passages, said water discharge ports in communication on one side with said access passages and on the opposite side to the ambient for discharging therealong any rain water of any elevated source of rain water beading on an external length portion of said electrical conductors and flowing in an ascending path of movement therealong, whereby said rain water flowing into said compartment does not short circuit said positive and negative electrical contacts on opposite sides of said contact-separating member and discharges from said miniature light body through said socket discharge ports.

* * * * *